US009988820B2

(12) United States Patent
Komatsu

(10) Patent No.: US 9,988,820 B2
(45) Date of Patent: Jun. 5, 2018

(54) PANEL CONSTRUCTION MEMBER AND MOUNTING STRUCTURE THEREOF

(71) Applicant: MITSUBISHI CHEMICAL CORPORATION, Chiyoda-ku (JP)

(72) Inventor: Kenjiro Komatsu, Chiyoda-ku (JP)

(73) Assignee: MITSUBISHI CHEMICAL CORPORATION, Chiyoda-ku (JP)

( * ) Notice: Subject to any disclaimer, the term of this patent is extended or adjusted under 35 U.S.C. 154(b) by 0 days. days.

(21) Appl. No.: 15/301,788

(22) PCT Filed: Mar. 23, 2015

(86) PCT No.: PCT/JP2015/058676
§ 371 (c)(1),
(2) Date: Oct. 4, 2016

(87) PCT Pub. No.: WO2015/156107
PCT Pub. Date: Oct. 15, 2015

(65) Prior Publication Data
US 2017/0175397 A1 Jun. 22, 2017

(30) Foreign Application Priority Data
Apr. 10, 2014 (JP) ..... 2014-081155

(51) Int. Cl.
*E04F 13/08* (2006.01)
*E04B 9/24* (2006.01)
(Continued)

(52) U.S. Cl.
CPC ..... *E04F 13/0803* (2013.01); *E04B 9/24* (2013.01); *E04F 13/072* (2013.01); *E04F 13/12* (2013.01)

(58) Field of Classification Search
CPC ..... E04F 13/072; E04F 13/12; E04F 13/0803; E04B 9/24
See application file for complete search history.

(56) References Cited

U.S. PATENT DOCUMENTS 2,293,331 A * 8/1942 Dahlberg ..... E04F 13/0803 52/387
3,559,358 A * 2/1971 Fowler et al. ..... E04F 13/0846 52/235
(Continued)

FOREIGN PATENT DOCUMENTS

AT 328147 B * 3/1976 ..... E04B 9/24
DE 2308342 A1 * 8/1974 ..... E04C 2/292
(Continued)

OTHER PUBLICATIONS

International Search Report dated May 19, 2015 in PCT/JP2015/058676 filed Mar. 23, 2015.
(Continued)

*Primary Examiner* — Babajide A Demuren
(74) *Attorney, Agent, or Firm* — Oblon, McClelland, Maier & Neustadt, L.L.P.

(57) ABSTRACT

Provided are a panel construction member and a mounting structure for the same that can be rigidly mounted to a building and for which the panel, after being mounted, has excellent flexural strength and flexural rigidity. A panel construction member 1 has a layered structure in which a core plate 4 is disposed between a pair of metal plates 2, 3, wherein the panel construction member 1 is provided with a groove 5 that extends along at least one pair of edges of the panel construction member 1, and an undercut portion 5*a* that penetrates between the metal plates 2, 3 from the groove 5. A rail member 6 is mounted in the groove 5 of the panel construction member 1, and the panel construction member 1 is mounted to a ceiling or a wall by means of the rail member 6.

9 Claims, 12 Drawing Sheets

(51) Int. Cl.
*E04F 13/072* (2006.01)
*E04F 13/12* (2006.01)

(56) References Cited

U.S. PATENT DOCUMENTS

| | | | | | |
|---|---|---|---|---|---|
| 5,167,106 | A * | 12/1992 | Ohno | E04F 13/0803 | 52/379 |
| 2006/0265988 | A1* | 11/2006 | Fujito | E04F 13/0889 | 52/511 |
| 2007/0022662 | A1 | 2/2007 | Morgenegg et al. | | |
| 2008/0127586 | A1* | 6/2008 | Carolan | E04C 2/292 | 52/309.9 |
| 2011/0083392 | A1 | 4/2011 | Timko et al. | | |
| 2015/0300017 | A1* | 10/2015 | Carolan | E04B 2/721 | 52/483.1 |

FOREIGN PATENT DOCUMENTS

| | | | | |
|---|---|---|---|---|
| EP | 2631380 | A1 * | 8/2013 | E04B 9/0435 |
| FR | 1056640 | A * | 3/1954 | E04F 13/0803 |
| GB | 1040078 | A * | 8/1966 | E04D 3/352 |
| JP | 54-50429 | | 4/1979 | |
| JP | 5-10609 | U | 2/1993 | |
| JP | 8-218597 | A | 8/1996 | |
| JP | 2007-332539 | A | 12/2007 | |
| JP | 2012-229525 | A | 11/2012 | |
| WO | WO 2008/077563 | A1 | 7/2008 | |

OTHER PUBLICATIONS

Extended European Search Report dated Oct. 26, 2017 in Patent Application No. 15777046.2.

* cited by examiner

PANEL CONSTRUCTION MEMBER AND MOUNTING STRUCTURE THEREOF

FIELD OF THE INVENTION

The present invention relates to a panel construction member installed on a ceiling or a wall of a building, and specifically, it relates to a layered composite panel construction member having a layered structure. More specifically, the present invention relates to a panel construction member that is provided, in its back surface, with an engaging groove for a mounting metal fitting. The present invention also relates to a mounting structure of the panel construction member.

BACKGROUND OF THE INVENTION

Patent Literature 1 describes a layered composite panel construction member having recessed portions in a back surface thereof. The panel construction member is mounted to a ceiling or a wall by engaging mounting metal fittings with the recessed portions, and mounting the panel construction member to the ceiling or the wall by means of the mounting metal fittings.

Patent Literature 2 describes an exterior panel having grooves in a back surface and end faces thereof. The exterior panel is mounted to a frame of a curtain wall unit by engaging mounting metal fittings with the grooves, and mounting the exterior panel to the frame of a curtain wall unit by means of the mounting metal fittings.

Patent Literature 1: Japanese Patent Publication 2007-332539 A

Patent Literature 2: Japanese Utility Model Publication H5-10609 A

In both Patent Literatures 1 and 2, the mounting metal fittings do not contribute to the improvement of flexural strength and flexural rigidity of the panel, and the flexural strength and flexural rigidity of the panel after being mounted are relatively low, since the mounting metal fittings are disposed on the four corners (corner portions) of the panel. When an exterior panel is mounted by the way of Patent Literature 2, an appearance of the exterior panel is unattractive, since the mounting metal fittings are exposed on the end faces of the exterior panel.

SUMMARY OF INVENTION

It is an object of the present invention to provide a panel construction member that can be rigidly mounted to a building, and a mounting structure of the panel construction member in which excellent flexural strength, flexural rigidity, and attractive appearance can be obtained.

A panel construction member of the present invention is a right-angled quadrilateral plate-like panel construction member having a layered structure in which a core plate is disposed between a pair of metal plates, wherein a groove that extends along four sides of the panel construction member is provided in a back surface of the panel construction member, and an undercut portion is provided between the metal plates. The undercut portion is recessed from the groove toward a center of the panel construction member.

In the present invention, the groove may be continuously provided throughout the circumference of the back surface of the panel construction member. The groove may exist in a region at a predetermined distance inwardly from the edge of the back side of the panel construction member.

A panel construction member with rail members of the present invention includes the panel construction member of the present invention, and rail members mounted to the back surface of the panel construction member, wherein the rail members are mounted to the panel construction member by engaging claw portions with the undercut portion.

In an aspect of the present invention, ends of adjacent rail members are abutted to each other.

In an aspect of the present invention, ends of rail members are cut diagonally to the longitudinal direction of the rail members.

In an aspect of the present invention, ends of adjacent rail members are connected to each other.

A mounting structure of a panel construction member of the present invention is characterized in that the panel construction member with rail members of the invention is mounted to a ceiling or a wall by means of rail members.

Advantageous Effects of the Invention

In the panel construction member and the mounting structure thereof of the present invention, rail members are engaged with a groove with an undercut portion provided on the four sides of the back surface of the panel construction member, and the panel construction member is installed on a ceiling or a wall by means of the rail members.

By engaging rail members with the groove on the four sides of the back surface of the panel construction member and mounting the rail members to the panel construction member as described above, flexural strength and flexural rigidity of the panel construction member are improved. In particular, by bonding or riveting the rail members to the metal plate on the back side of the panel construction member, the flexural strength and flexural rigidity of the panel construction member are improved. The groove and rail members are not exposed on the front side of the panel construction member, and the appearance is attractive.

DESCRIPTION OF EMBODIMENTS

Figure 1:
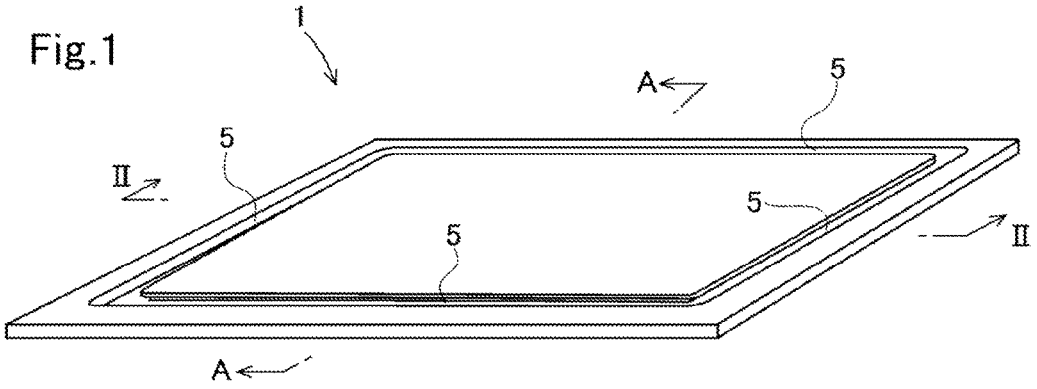
FIG. 1 is a perspective view of the back side of a panel construction member according to an embodiment.
Figure 2:
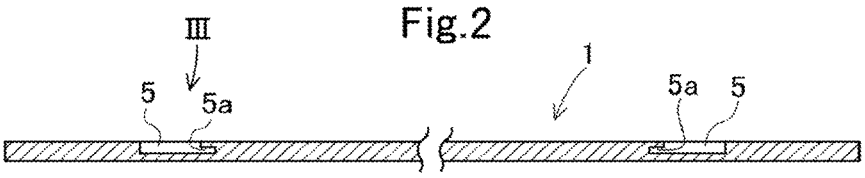
FIG. 2 is a sectional view taken along line II-II of FIG. 1.
Figure 3:
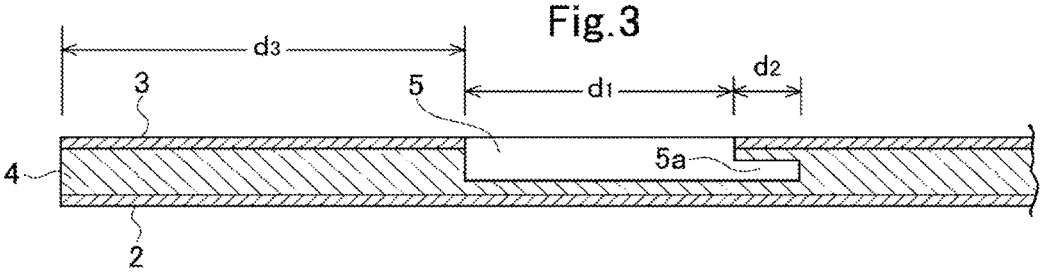
FIG. 3 is an enlarged view of part III of FIG. 2.
Figure 4:
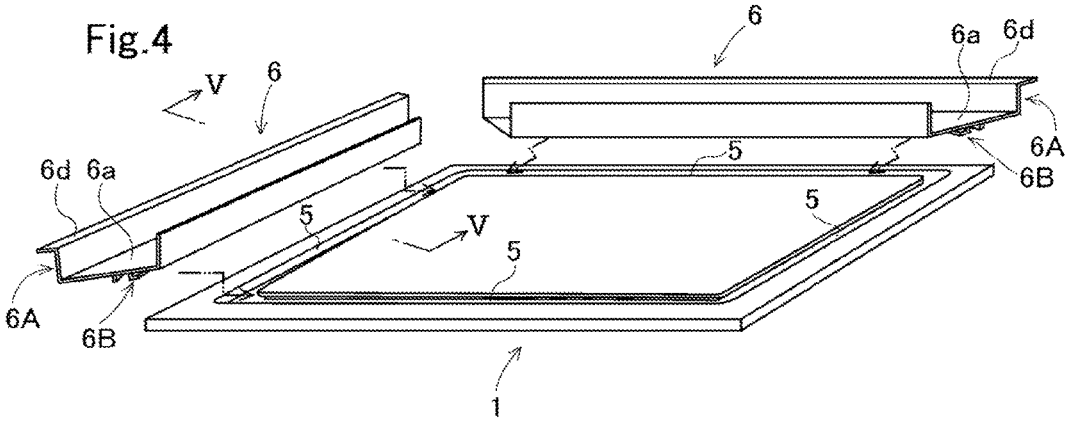
FIG. 4 is a perspective view showing the mounting of rail members to the panel construction member 1 of FIG. 1.

Embodiments will now be described with reference to the drawings. FIGS. 1 to 3 show a panel construction member 1 according to a first embodiment. FIG. 2 is a sectional view taken along line II-II of FIG. 1, and a sectional view taken along line A-A of FIG. 1 is the same as FIG. 2.

As shown in FIG. 3, the panel construction member 1 is a layered composite panel in which a core plate 4 made of synthetic resin foam such as foamed polyethylene or synthetic resin plate such as polyethylene is interposed and bonded between metal plates 2 and 3 made of aluminum, steel such as stainless steel or Galvalume steel plate, titanium, or the like. The metal plate 2 forms the front surface of the panel construction member 1. The surface of at least one of the metal plates 2 and 3 may be painted. The bonding surfaces of the metal plates 2 and 3 with the core plate 4 may be subjected to a primer treatment.

The panel construction member has a shape of a right-angled quadrilateral (a rectangle or a square). In the back surface of the panel construction member 1, a groove 5 is provided so as to extend along the four sides. The groove 5 continuously extends so as to surround the whole circumference of the panel construction member 1.

The groove 5 is provided with an undercut portion 5*a* that is recessed from the groove 5 under the metal plate 3 on the back side. The undercut portion 5*a* is recessed from the groove 5 toward the plate center of the panel construction member 1. The groove 5 is formed using an end mill. The groove 5 penetrates the metal plate 3 on the back side, and reaches very close to the metal plate 2 on the front side. The undercut portion 5*a* is formed by cutting the core plate 4 from the groove 5 toward the plate center. The groove 5 preferably exists in a region at a predetermined distance inwardly from the edge on the back side because the groove 5 and rail members 6 are not exposed on the front side of the panel construction member 1, and the appearance is attractive.

However, the method for forming the groove 5 and the undercut portion 5*a* is not limited to the above.

When the panel construction member is used as a ceiling panel, and the groove is provided in the peripheral part of the panel construction member, the whole undercut portion is provided so as to protrude from the groove toward the plate center. When the panel construction member is used as a wall panel, the groove disposed on the lower side of the wall panel preferably has the undercut portion being recessed upward from the groove. The groove disposed on the upper side of the wall panel preferably has the undercut portion being recessed downward from the groove.

The thickness of the panel construction member 1 is preferably about 2 to 12 mm, and more preferably about 3 to 6 mm. The thickness of the metal plates 2 and 3 is preferably about 0.1 to 0.6 mm. The thickness of the core plate 4 is preferably about 1 to 11 mm, and more preferably about 2 to 5 mm. The length of one side of the panel construction member 1 is preferably about 300 to 3500 mm. The width $d_1$ (FIG. 3) of the groove 5 on the back side of the panel construction member 1 is preferably about 10 to 16 mm, and the width $d_2$ of the undercut portion 5*a* is preferably about 2 to 5 mm. The distance $d_3$ from the edge of the panel construction member 1 to the groove 5 is preferably about 3 mm or more. However, these sizes are illustrative, and the panel construction member of the present invention is not limited to these.

Figure 5:
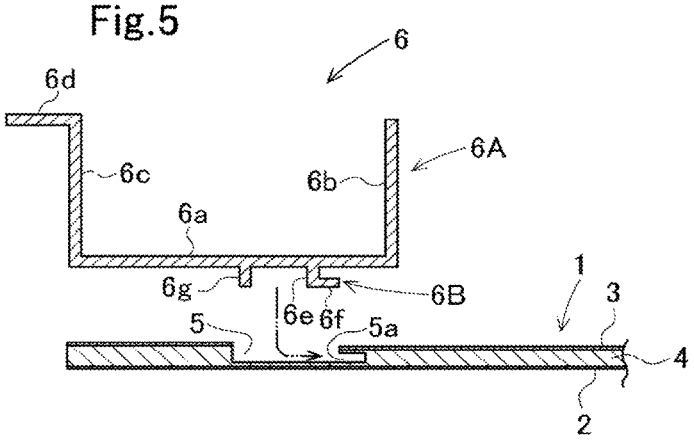
FIG. 5 is a sectional view taken along line V-V of FIG. 4.

FIGS. 4 to 7*a* and 7*b* show the configuration for mounting rail members 6 to the panel construction member 1. As shown in FIG. 5, the rail members 6 each have a main body portion 6A having a substantially U cross-sectional shape and a claw portion 6B protruded from the main body portion 6A and having an L cross-sectional shape.

The main body portion 6A has a main piece portion 6*a*, and standing piece portions 6*b* and 6*c* standing from both sides of the main piece portion 6*a* in the same direction in parallel with each other. From the distal end in the standing direction of the standing piece portion 6*c*, a protruding piece portion 6*d* parallel to the main piece portion 6*a* protrudes away from the standing piece portion 6*b*.

The claw portion 6B is protruded from the main piece portion 6*a* in a direction opposite to the standing piece portions 6*b* and 6*c*. The claw portion 6B has a standing portion 6*e* standing from the main piece portion 6*a*, and a hook portion 6*f* protruding in parallel with the main piece portion 6*a* from the distal end in the standing direction of the standing portion 6*e*. In this embodiment, a protrusion 6*g* is erected in parallel with the claw portion 6B from the main piece portion 6*a*.

Figure 6:
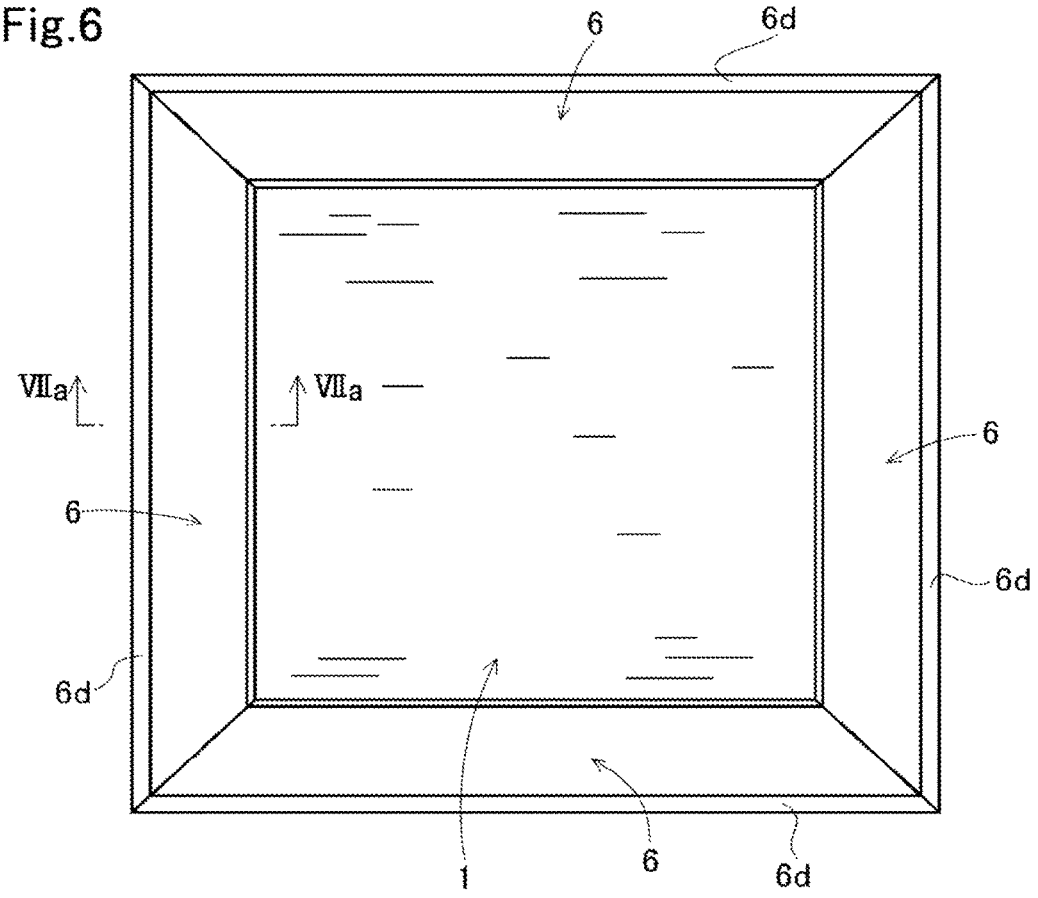
FIG. 6 is a back view of the panel construction member to which rail members are mounted.
Figure 7A:
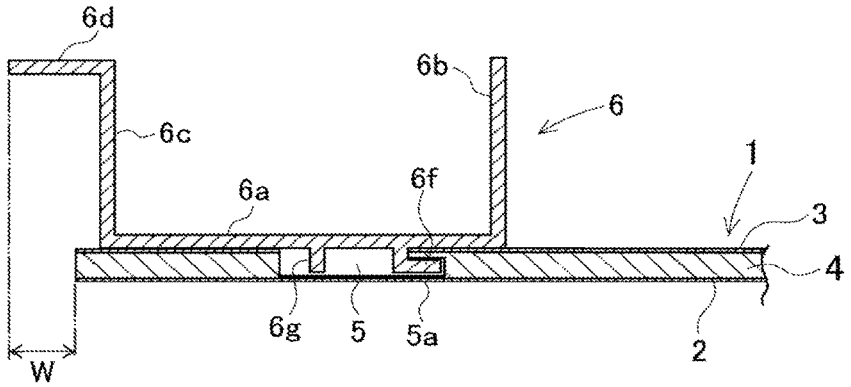
FIG. 7*a* is a sectional view taken along line VIIa-VIIa of FIG. 6.
Figure 7B:
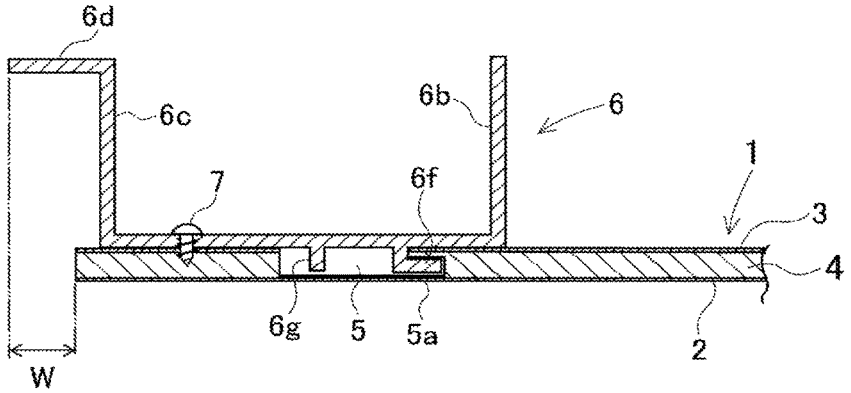
FIG. 7*b* is a sectional view showing another aspect.

Both longitudinal ends of each rail member 6 are cut at 45° with respect to the longitudinal direction of the rail member 6 as shown in FIG. 6. As shown in FIGS. 4, 5, 7*a*, and 7*b*, each rail member 6 is attached to the panel construction member 1 by inserting the claw portion 6B and the protrusion 6*g* into the groove 5, inserting the hook portion 6*f* into the undercut portion 5*a*, and placing the main piece portion 6*a* on the back side of the panel construction member 1. The main piece portion 6*a* and the panel construction member 1 are bonded to each other by adhesive (not shown) preliminarily applied to the main piece portion 6*a* or the panel construction member 1 as shown in FIG. 7*a*, or are fastened to each other with screws 7 or rivets (not shown) as shown in FIG. 7*b*.

As shown in FIGS. 7*a* and 7*b*, in a state where the rail member 6 is mounted to the panel construction member 1, the protruding piece portion 6*d* protrudes outward from the peripheral edge of the panel construction member 1 by a predetermined length w. Since, as described above, both ends of each rail member 6 are cut at 45° with respect to the longitudinal direction of the rail member 6, both longitudinal ends of the four rail members 6 are abutted to each other as shown in FIG. 6 so that the four rail members 6 form a frame shape. The rail members 6 are formed, for example, of an aluminum extruded material. However, the present invention is not limited to this.

Figure 8:
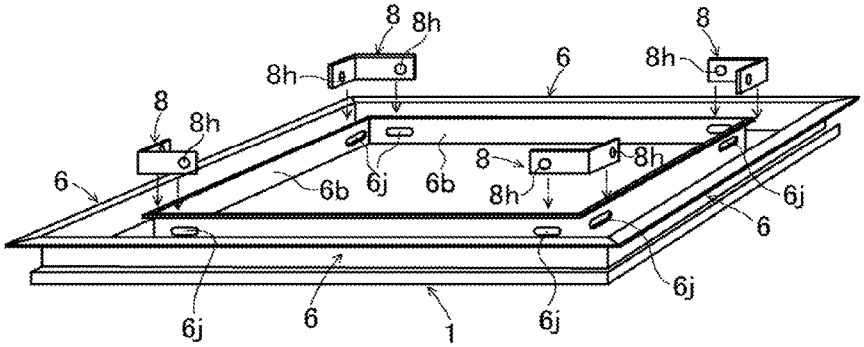
FIG. 8 is a perspective view of the back side of a panel construction member according to another embodiment.

The rail members 6 abutted to each other are preferably connected to each other with connecting metal fittings 8 as shown in FIG. 8. The connecting metal fittings 8 are L-shaped and have holes 8*h*. By providing slots 6*j* in the standing piece portions 6*b* of the rail members 6, passing bolts (not shown) through the holes 8*h* and the slots 6*j*, and tightening the bolts with nuts, the rail members 6 are connected to each other.

An example mounting structure of the panel construction member 1 with rail members 6 to a ceiling or a wall will be described below with reference to FIGS. 9 to 12*a* and 12*b*.

Figure 9:
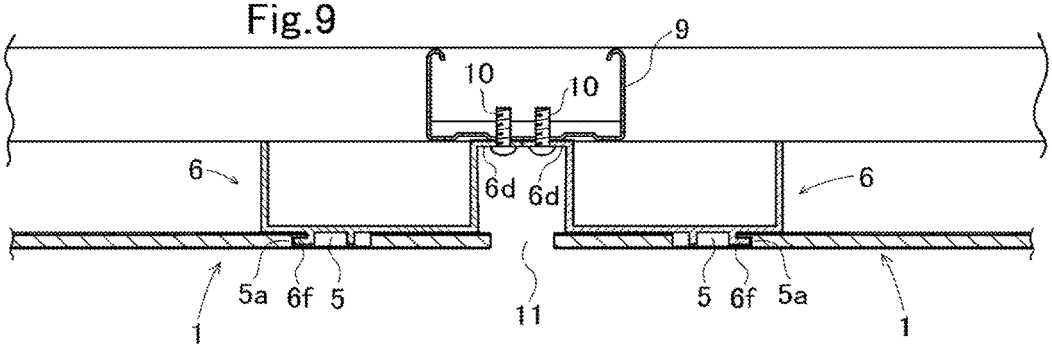
FIG. 9 is a vertical sectional view showing a mounting structure of the panel construction member of FIG. 6 to a ceiling.

FIG. 9 shows an example of mounting of the panel construction member 1 to a ceiling. A beam member 9 is installed on a ceiling of a building. The protruding piece portion 6*d* of the panel construction member 1 with rail members 6 are attached to the beam member 9 with bolts 10. The protruding piece portions 6*d*, 6*d* of adjacent panel construction members 1 are abutted to each other. Since the protruding piece portion 6*d* protrudes outward from the peripheral part of the panel construction member 1 by a predetermined length w, a joint gap 11 having a width of 2*w* is formed between adjacent panel construction members 1. The bolts 10 are screwed through this joint gap 11.

Figure 10:
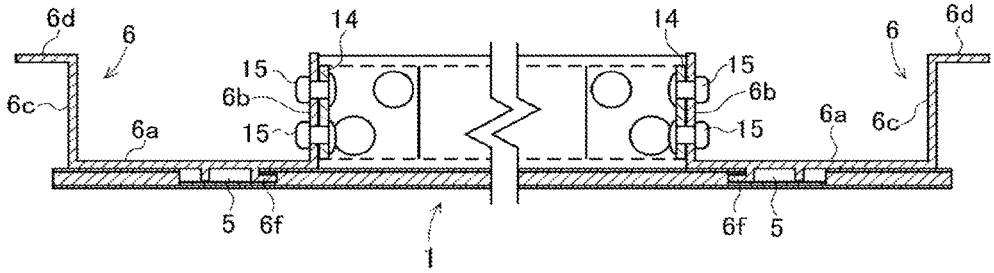
FIG. 10 is a vertical sectional view showing another mounting structure of the panel construction member to a ceiling.

FIG. 10 shows a mounting structure in which the panel construction member 1 is installed on a ceiling by fastening the standing piece portions 6*b* of the rail members 6 to a beam member 14 of the ceiling with rivets 15. In other respects, the configuration of FIG. 10 is the same as that of FIG. 9, and the same signs designate the same parts.

Figure 11:
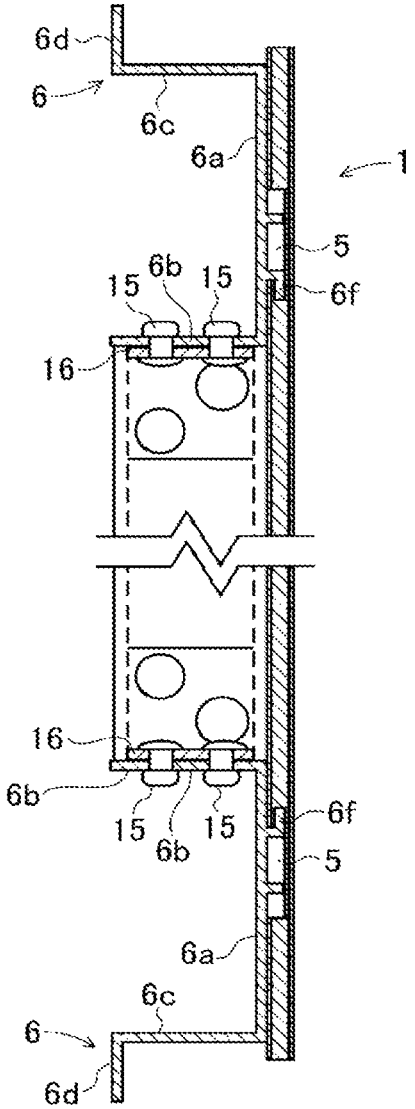
FIG. 11 is a vertical sectional view showing a mounting structure of the panel construction member to a wall.

FIG. 11 shows a mounting structure in which the panel construction member 1 is installed on a wall by fastening the standing piece portions 6*b* of the rail members 6 to a horizontal frame 16 of the wall with rivets 15. The standing piece portions 6*b* are placed on the upper surface of the horizontal frame 16 or abutted on the lower surface of the horizontal frame 16, and are fastened with rivets 15.

Figure 12A:
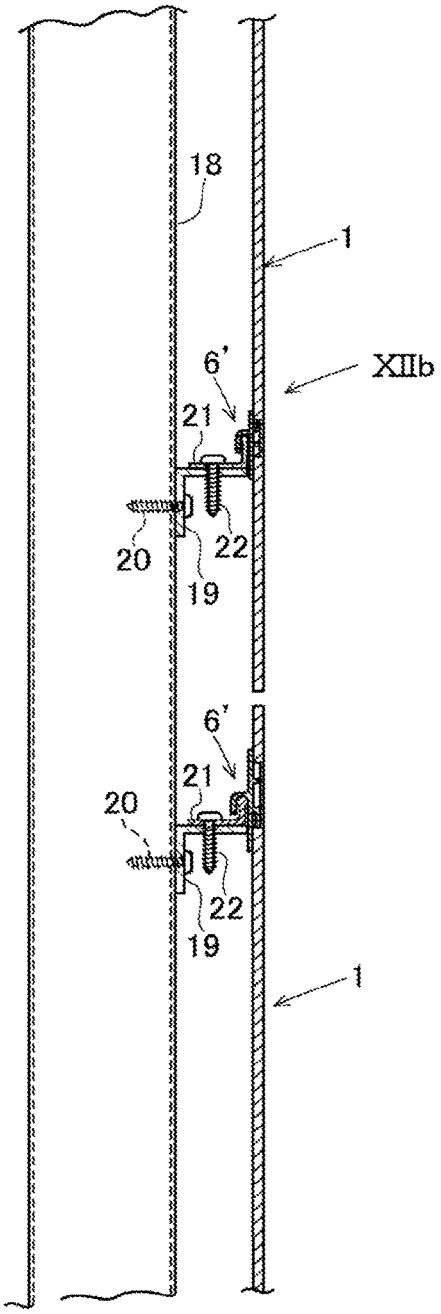
FIG. 12*a* is a vertical sectional view showing another mounting structure of the panel construction member to a wall.
Figure 12B:
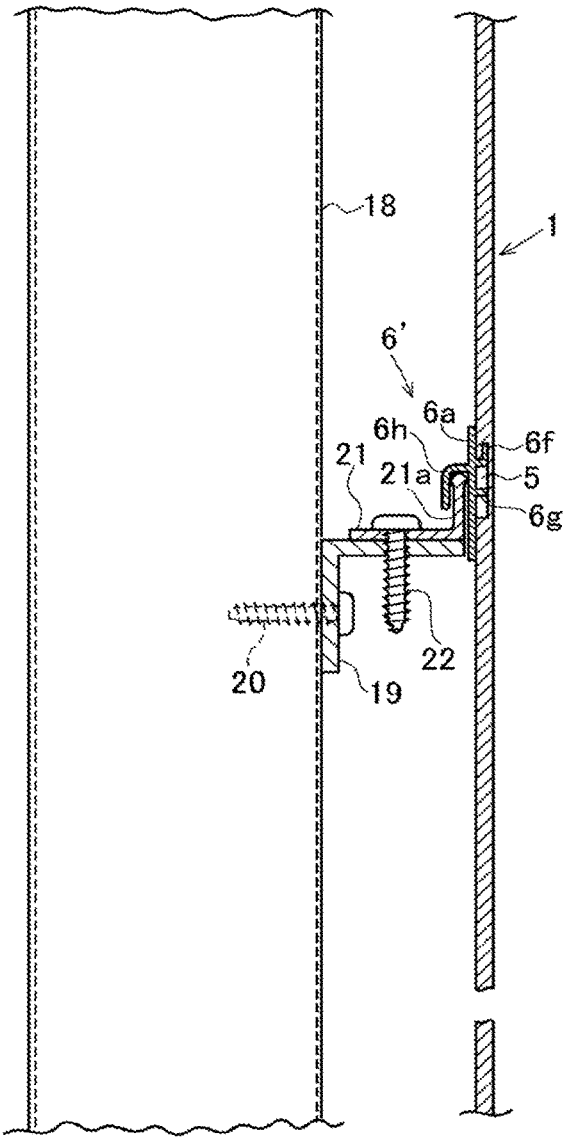
FIG. 12*b* is an enlarged view of part XIIb of FIG. 12*a*.

FIGS. 12*a* and 12*b* show a structure in which rail members 6' having a shape slightly overlapping that of the rail members 6 are mounted to the panel construction member 1, and the panel construction member 1 is installed on a wall by means of the rail members 6'.

Although the rail members 6' are the same as the rail members 6 in that they have a main piece portion 6*a*, hook portion 6*f*, and protrusion 6*g*, they are provided with neither a standing piece portion 6*b* nor 6*c* nor a protruding piece portion 6*d*. In the rail members 6', a hook piece portion 6*h* is protruded from the main piece portion 6*a* to the opposite side of the hook portion 6*f*. The hook piece portion 6*h* has a substantially L cross-sectional shape such that it stands from the main piece portion 6*a* and then extends in a direction opposite to the extending direction of the hook portion 6*f*. In the state of FIGS. 12*a* and 12*b* in which the panel construction member 1 is installed on a wall, the hook portion 6*f* faces upward, and the hook piece portion 6*h* faces downward. In FIGS. 12*a* and 12*b*, the undercut portion is provided so as to protrude upward from the groove 5 regardless of whether it is on the upper side or lower side of the panel construction member 1.

A first L metal fitting 19 is fastened to a pillar or a vertical frame 18 of a building with screws 20, and a second L metal fitting 21 is fixed to the first L metal fitting 19 with screws 22. A vertical piece 21*a* stands upward from the end of the second L metal fitting 21 that is closest to the panel construction member 1. The hook piece portion 6*h* of the rail member 6' is engaged with this vertical piece 21*a* so as to be dropped from above. That is, the vertical piece 21*a* is inserted between the hook piece portion 6*h* and the main piece portion 6*a*. Thereby, the panel construction member 1 is installed so as to be hooked on the pillar or the vertical frame 18.

Figure 13A:
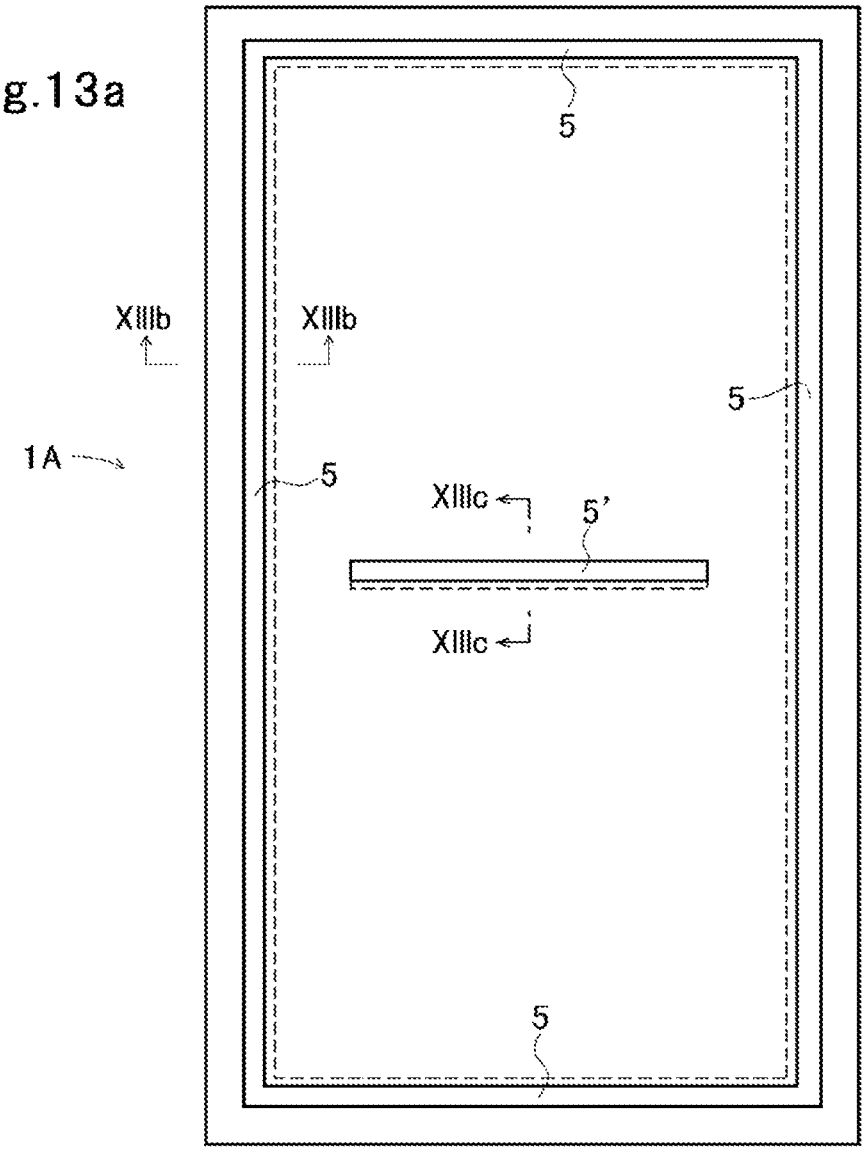
FIG. 13*a* is a back view of a panel construction member according to still another embodiment.
Figure 13B:
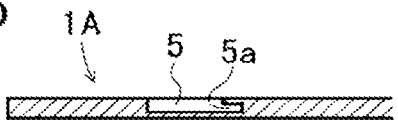
FIGS. 13*b* and 13*c* are sectional views taken along line XIIIb-XIIIb and line XIIIc-XIIIc of FIG. 13*a*.
Figure 13C:
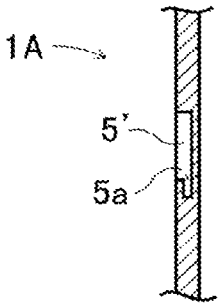

In the present invention, in the case of a rectangular panel construction member 1A the long side of which is long as shown in FIG. 13, a groove 5' extending in the lateral width direction of the panel construction member 1A may be provided near the center of the back surface. Both longitudinal ends of the groove 5' are separated from the groove 5. The cross-sectional configuration of the groove 5' is the same as that of the groove 5 as shown in FIG. 13*c*. In other respects, the configuration of the panel construction member 1A is the same as that of the panel construction member 1, and the same signs designate the same parts. The same rail member as the rail members 6 is fitted in the groove 5', and is connected to a beam member, horizontal frame, vertical frame, pillar, or the like together with the rail members 6 fitted in the groove 5 in the peripheral part.

In FIG. 13*a*, since one groove 5' is provided, a frame-like groove 5 and a linear groove 5' exist in the back surface of the panel construction member 1A. However, a plurality of grooves 5' may be provided in parallel with each other.

Instead of the groove 5', a circular recessed portion as in Patent Literature 1 may be provided near the plate center of the back surface of the panel construction member 1, and a metal fitting may be fitted in this recessed portion and may be connected to a beam member, horizontal frame, or pillar.

Figure 14:
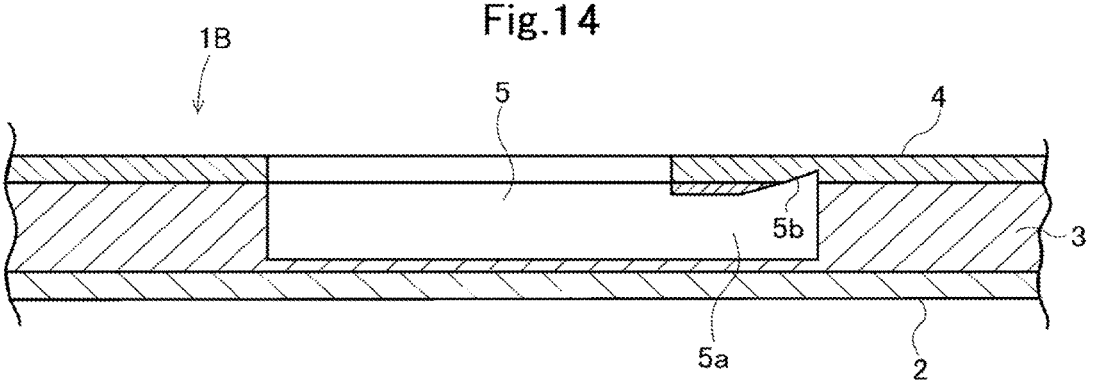
FIG. 14 is a sectional view of part of a panel construction member according to still another embodiment.

Although the groove 5 continuously extends along the sides of the panel construction member from one end to the other end of each side in the above embodiment, the groove 5 may be arranged so as to be interrupted at one or a plurality of places. In the present invention, as shown in the panel construction member 1B of FIG. 14, the undercut portion 5*a* may be provided with a recess 5*b* cutting into the back side of the panel, and the hook portion 6*f* of the rail member may be provided with a protrusion (not shown) engaging with the recess 5*b*. This improves the locking strength of the rail member to the panel construction member 1B.

Figure 15:
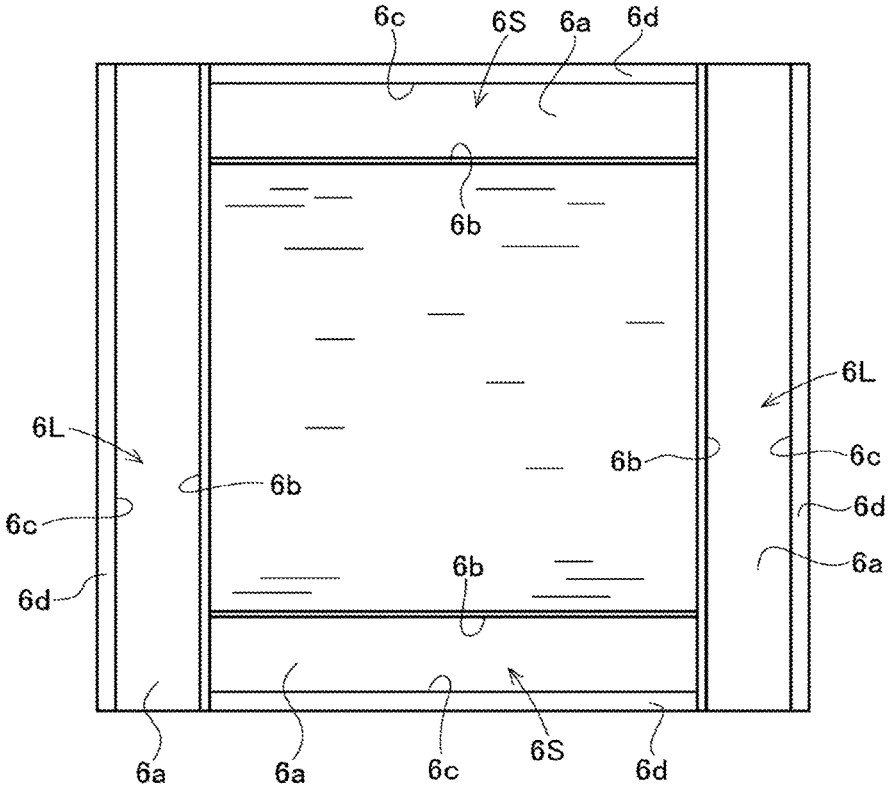
FIG. 15 is a back view of a panel construction member with rail members according to another embodiment.
Figure 16:
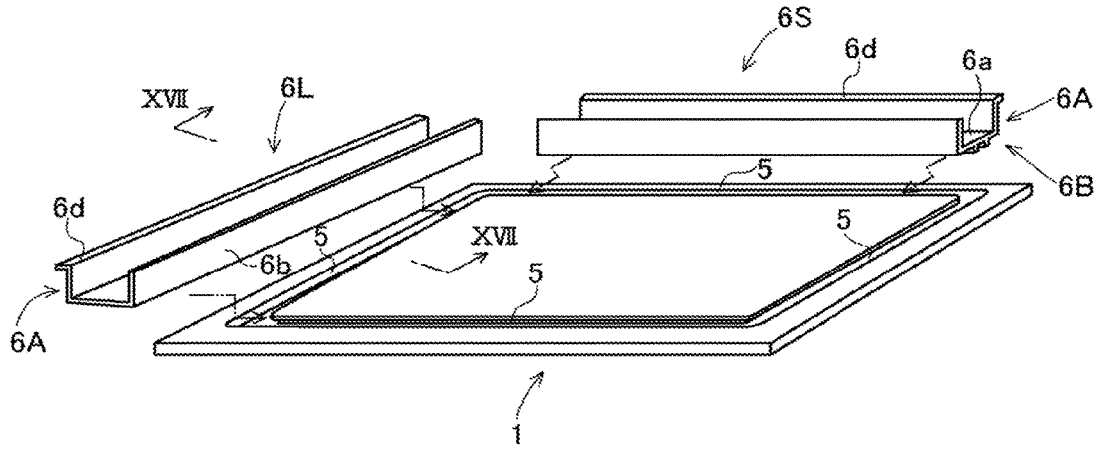
FIG. 16 is an exploded perspective view of a panel construction member with rail members according to another embodiment.
Figure 17:
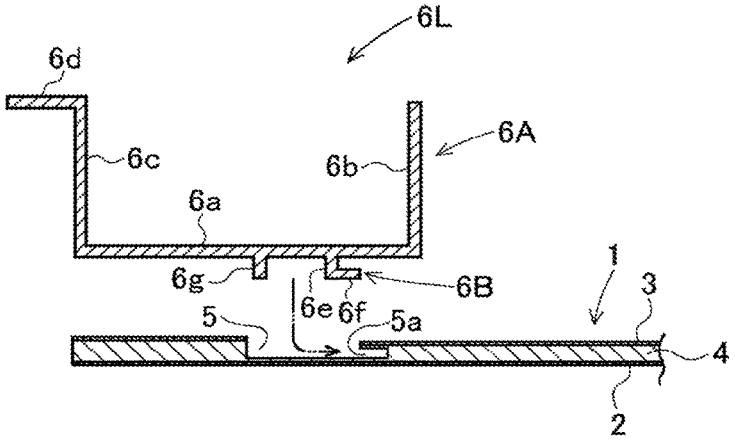
FIG. 17 is a sectional view taken along line XVII-XVII of FIG. 16.

In the above embodiment, both ends of each rail member 6 are cut at 45° and ends of rail members 6 are abutted to each other. However, as shown in FIGS. 15 and 16, a pair of relatively long rail members 6L both end faces of which are perpendicular to the longitudinal direction of the rail member, and a pair of relatively short rail members 6S may be used in combination. In the rail members 6S, the claw portion 6B continuously extends from one end to the other end. In the rail members 6L, the claw portion 6B is provided only in a range engaging with the groove 5. In other respects, the configurations of the rail members 6L and 6S are the same as that of the rail member 6. As shown in FIG. 17, as with the rail member 6, the claw portions 6B and the protrusions 6*g* of the rail members 6L and 6S are inserted into the groove 5, the hook portions 6*f* are inserted into the undercut portion 5*a*, and the rail members 6L and 6S are thereby engaged with the panel construction member 1. The rail members 6L and 6S are then fixed to the panel construction member 1 with adhesive or screws.

The end faces of the short rail members 6S are abutted on the standing piece portions 6*b* at the ends of the rail members 6L. Preferably, the rail members 6S and 6L are connected with connecting metal fittings 8 as in FIG. 8.

Figure 18:
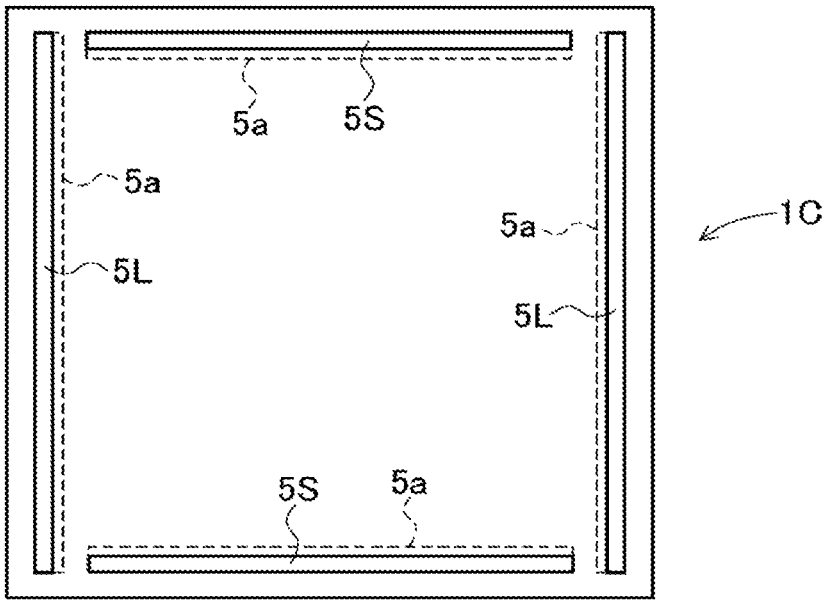
FIG. 18 is a back view of a panel construction member according to still another embodiment.

In the panel construction member 1 of FIG. 16, a groove 5 is continuously provided along the four sides of the panel construction member 1 throughout the circumference. However, as in the panel construction member 1B of FIG. 18, grooves 5S engaged with the short rail members 6S and grooves 5L engaged with the long rail members 6L may be discontinuous with each other. That is, the grooves 5S are located between the ends of the grooves 5L, and are slightly separated from the grooves 5L. After inserting the claw portions 6B and the protrusions 6*g* of the long rail members 6L into the grooves 5L, the rail members 6L are moved toward the plate center of the panel construction member 1C in order to engage the hook portions 6*f* with the undercut portions 5*a*. The ends of the short rail members 6S and the standing piece portions 6*c* of the long rail members 6L are abutted on each other.

Figure 19:
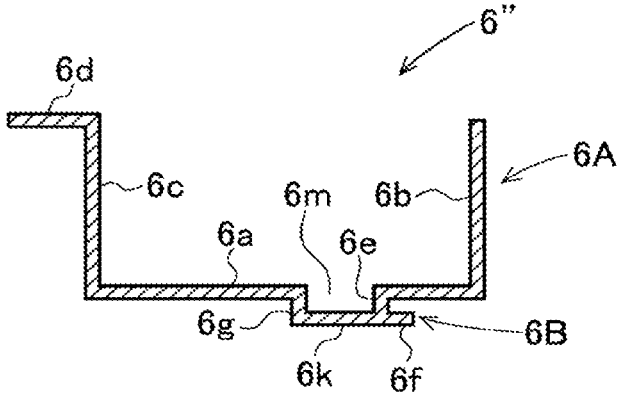
FIG. 19 is a sectional view of a rail member.

FIG. 19 shows another shape of the claw portion of a rail member. In the rail member 6", the distal end of the standing portion 6*e* and the distal end of the protrusion 6*g* are connected by a connecting plate portion 6*k*. In the main piece portion 6*a*, a recessed portion 6*m* surrounded by the standing portion 6*e*, the protrusion 6*g*, and the connecting plate portion 6*k* is formed. In other respects, the configuration of the rail member 6" is the same as that of the rail member 6.

In any of the panel construction members, rail members 6, 6L, 6S, 6" are fitted in grooves 5, 5L, 5S extending along the four sides of the panel construction member, and therefore the flexural strength and flexural rigidity of the panel construction member are high in all directions. Because stress generated when external force is applied to the panel construction member is dispersed, the installation strength of the panel construction member is also high. The grooves and rail members are not exposed on the front side of the panel construction member, and the appearance is attractive.

In the present invention, an undercut portion 5*a* with which the hook portion 6*f* of the claw portion 6B of the rail member engages is provided so as to extend from the groove 5 toward the plate center (the center of the plate) of the panel construction member. Owing to this, compared to a case where the undercut portion 5*a* extends outward, the mounting strength of the panel construction member to the rail members is increased. The reason for this will be described with reference to FIGS. 20 and 21.

Figure 20:
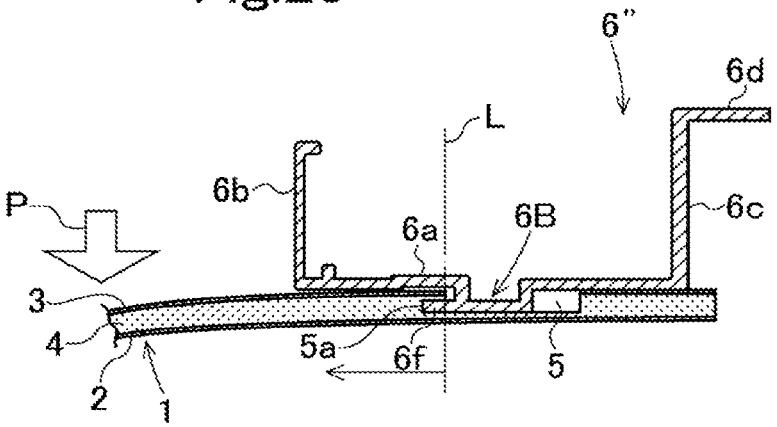
FIG. 20 is a sectional view showing the deformed shape of a panel construction member with rail members.

FIG. 20 shows an example in which a rail member 6" is mounted to a panel construction member 1 in which an undercut portion 5*a* is provided from a groove 5 toward the plate center. In this case, when pressure is applied to the plate center side of the panel construction member 1 as shown by arrow P, only part of the panel construction member 1 that is on the plate center side of the vicinity of L in the figure deforms away from the main piece portion 6*a*. Because L in this case is near the plate center side end of the groove 5, the area of part that tries to move away from the main piece portion 6*a* is small, and stress generated near the undercut portion 5*a* is small.

Figure 21:
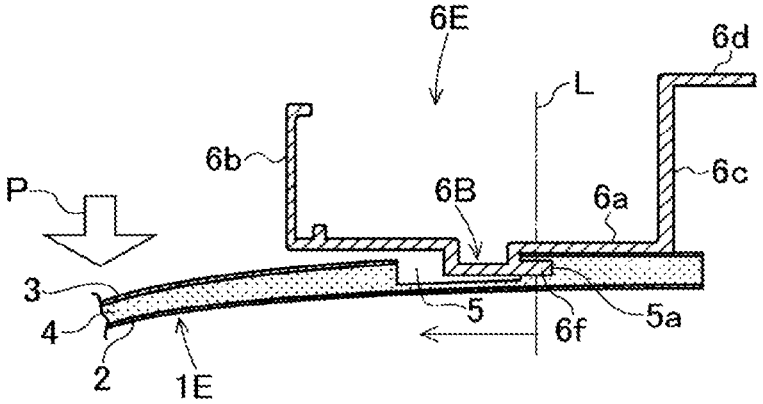
FIG. 21 is a sectional view showing the deformed shape of a panel construction member with rail members.

FIG. 21 shows a comparative example in which a rail member 6E is mounted to a panel construction member 1E in which an undercut portion 5*a* is provided from a groove 5 toward the plate periphery (the outer edge of the panel construction member 1E). The hook portion 6*f* of the rail member 6E is protruded from the claw portion 6B toward the plate periphery, and is engaged with the undercut portion 5*a*. In other respects, the configurations of the panel construction member 1E and the rail member 6E are the same as those of the panel construction member 1 and the rail member 6" of FIG. 20.

In the case of FIG. 21, when pressure P is applied to the plate center side of the panel construction member 1E in the arrow direction, part of the panel construction member 1E that is on the plate center side of the vicinity of L in the figure deforms away from the main piece portion 6*a*. Because this L is near the plate periphery side end of the groove 5, the panel construction member 1E and the main piece portion 6*a* are separated from each other in a wide range, and large stress is generated near the undercut portion 5*a*.

As is clear from FIGS. 20 and 21, the supporting strength and durability of the panel construction member are improved by providing an undercut portion 5*a* from the groove 5 toward the plate center.

Although particular embodiments of the present invention have been described in detail, it is obvious to those skilled in the art that various changes may be made without departing from the spirit and scope of the present invention.

This application claims the benefit of Japanese Patent Application No. 2014-081155 filed Apr. 10, 2014, which is hereby incorporated by reference herein in its entirety.

REFERENCE SIGNS LIST

1, 1A, 1B, 1C panel construction member
2, 3 metal plate
4 core plate
5, 5' groove
5*a* undercut portion
5*b* recess
6, 6', 6" rail member
6A main body portion
6B claw portion
6*a* main piece portion
6*b*, 6*c* standing piece portion
6*d* protruding piece portion
6*f* hook portion
8 connecting metal fitting
9, 14 beam member
16 horizontal frame

The invention claimed is:

1. A panel construction member with rail members comprising:

a right-angled quadrilateral panel construction member having a layered plate structure in which a core plate is disposed between a pair of metal plates, wherein a groove is provided in a back surface of the right-angled quadrilateral panel construction member, the groove extending along four sides of the right-angled quadrilateral panel construction member, and an undercut portion is provided between the metal plates, the undercut portion being recessed from the groove toward a center of the right-angled quadrilateral panel construction member; and rail members mounted to the back surface of the right-angled quadrilateral panel construction member, wherein the rail members are mounted to the right-angled quadrilateral panel construction member by engaging claw portions with the undercut portion, wherein the rail members are connected to each other with a connecting metal fitting.

2. The panel construction member with rail members according to claim 1, wherein ends of adjacent rail members are abutted to each other.

3. The panel construction member with rail members according to claim 2, wherein ends of rail members are cut diagonally to the longitudinal direction of the rail members.

4. The panel construction member with rail members according to claim 1, wherein ends of adjacent rail members are connected to each other.

5. A mounting structure of a panel construction member, wherein the panel construction member with rail members according to claim 1 is mounted to a ceiling or a wall by means of the rail members.

6. The panel construction member with rail members according to claim 1, wherein the groove has four portions along the four sides of the right-angled quadrilateral panel construction member, and the rail members are mounted to each of the portions.

7. The panel construction member with rail members according to claim 1, wherein the rail members include a pair of first rail members and a pair of second rail members, wherein the first and second rail members have both end faces being perpendicular to the longitudinal direction of the rail member, wherein the second rail members are shorter than the first rail members, and wherein the second rail members are arranged between ends of each first rail members.

8. The panel construction member with rail members according to claim 7, wherein ends of the first rail members and the second rail members are connected to each other.

9. The panel construction member with rail members according to claim 7, wherein ends of the first rail members and the second rail members are connected with a connecting metal fitting.

* * * * *